United States Patent [19]

Karbach et al.

[11] Patent Number: 4,884,408

[45] Date of Patent: Dec. 5, 1989

[54] METHOD OF CONTROLLING A COMBUSTION PROCESS YIELDING WATER VAPOR

[75] Inventors: Alfred Karbach, Bad Vibbel; Georg Schaub, Frankfurt am Main; Rolf Peters, Neu-Anspach, all of Fed. Rep. of Germany

[73] Assignee: Metallgesellschaft Aktiengesellschaft, Frankfurt am Main, Fed. Rep. of Germany

[21] Appl. No.: 295,261

[22] Filed: Jan. 9, 1989

[30] Foreign Application Priority Data

Jan. 14, 1988 [DE] Fed. Rep. of Germany ..... 3800863

[51] Int. Cl.[4] ..... F01K 13/02

[52] U.S. Cl. ..... 60/667; 60/665

[58] Field of Search ..... 60/664, 665, 667

[56] References Cited

U.S. PATENT DOCUMENTS

| | | | |
|---|---|---|---|
| 3,906,731 | 9/1975 | Carlson | 60/667 X |
| 4,039,846 | 8/1977 | Vance | 60/667 X |
| 4,064,699 | 12/1977 | Martz | 60/667 X |
| 4,086,773 | 5/1978 | Kanegae et al. | 60/667 X |
| 4,593,527 | 6/1986 | Nakamoto | 60/667 X |

*Primary Examiner*—Allen M. Ostrager
*Attorney, Agent, or Firm*—Herbert Dubno

[57] ABSTRACT

The production of water vapor is controlled in a plant for combusting fine-grained and dustlike solid fuels together with air in a combustion zone of a heat exchanger in the upper region of the combustion zone, a water vapor accumulator, which communicates with the heat exchanger, and a water vapor feed line leading from the water vapor accumulator to a turbine. The rate at which water vapor is produced is continually calculated and is compared with the desired value which is required by the turbine and the rates at which fuel and combustion air are supplied to the combustion zone are adjusted in accordance therewith. The combustion plant may comprise a fluidized bed cooler for cooling a part of the part of the combustion residue. That cooler may comprise a plurality of chambers provided with heat exchangers for an evaporation of feed water or for a super heating of water vapor. Any water vapor which is produced from feed water in said chambers will also be taken into account in the calculation of the total rate at which water vapor is produced in the combustion plant.

3 Claims, 1 Drawing Sheet

METHOD OF CONTROLLING A COMBUSTION PROCESS YIELDING WATER VAPOR

FIELD OF THE INVENTION

Our present invention relates to a method of controlling a combustion process and, more particularly, to a method of controlling the production of water vapor in a plant for combusting fine-grained and dustlike solid fuels together with air in the combustion zone of a circulating fluidized bed system, and wherein the plant comprises a heat exchanger disposed in the upper portion of the combustion zone, a water vapor accumulator, which communicates with the heat exchanger, and a water vapor feed line leading from the water vapor accumulator to a turbine.

BACKGROUND OF THE INVENTION

Steam-producing plants in which a combustion is effected in a circulating fluidized bed system and fluidized bed coolers are used for a recovery of the thermal energy contained in the combustion residue are known and have been described in European Patent No. 0 046 406 and in the European Patent Publication No. 0 033 713. Details of such plants are also known from U.S. Pat. Nos. 3,672,069; 4,111,158; and 4,165,717.

If the water vapor produced in such plants is utilized to produce power in a power plant, any changes influencing the steam production must be detected in time so that control actions can be taken quickly and the rate of steam production will be as constant as possible.

OBJECT OF THE INVENTION

It is an object of the invention to provide an improved method of controlling such a combustion system for production of power at a constant rate and to ensure that water vapor will be supplied to the turbine at a virtually constant rate.

SUMMARY OF THE INVENTION

In the above-described process, this object is attained in accordance with the invention in that the rate at which water vapor is produced in the heat exchanger is continually calculated and compared with the desired rate which is required by the turbine and the rates at which fuel and combustion air are supplied to the combustion zone are adjusted in accordance.

The process may also be used for a combustion plant which comprises a fluidized bed cooler, which has a plurality of chambers and is supplied with part of the combustion residue. The rate at which water vapor is produced in the fluidized bed cooler is added to the rate at which water vapor is produced in the combustion zone.

According to a feature of the invention, the pressure and temperature above and below the heat exchanger disposed in the combustion zone and the temperature in the chambers which contain evaporators are continuously measured and in consideration of the results of said measurements and heat transfer coefficients (K values) of the evaporators are calculated in a control system, the temperature in the steam accumulator is measured and in dependence on the K values heat fluxes to the evaporators and the resulting instantaneous total rate of water vapor production are calculated. That calculated total rate is compared in at least one controller with the desired value and the rates at which fuel and combustion air are supplied are changed in dependence on the difference.

BRIEF DESCRIPTION OF THE DRAWING

The above objects, features and advantages of our invention will become more readily apparent from the following description, reference being made to the accompanying drawing in which.

SPECIFIC DESCRIPTION

Figure 1:
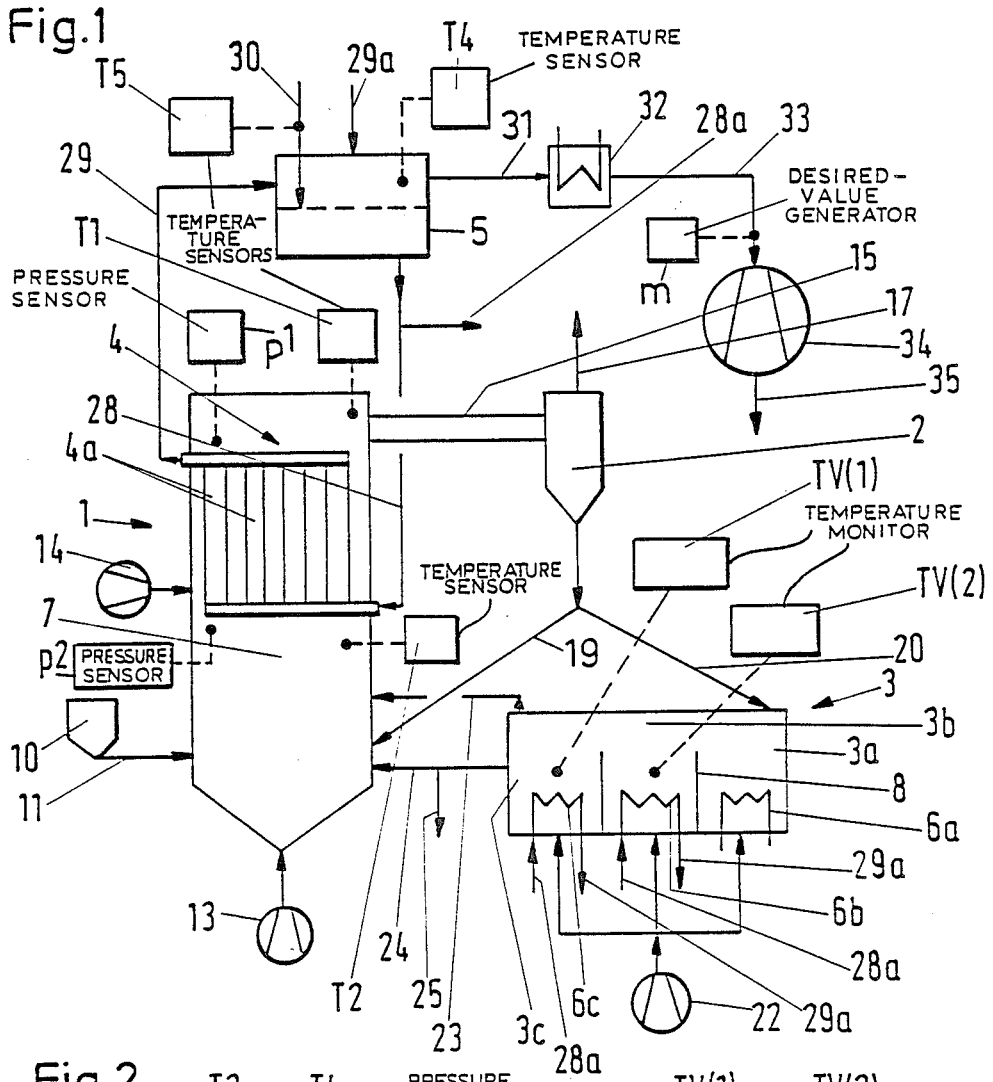
FIG. 1 is a diagrammatic representation of a plant to be controlled according to the invention.

The plant for producing water vapor consists of a circulating fluidized bed system 1 including a separating cyclone 2, 1 fluidized bed cooler 3, a heat exchanger 4 and a water vapor accumulator 5. The heat exchanger 4 is disposed in the upper portion of the combustion zone 7 and can consist of parallel vertical tubes 4*a*, which preferably constitute an annular array on the inside of the wall defining the combustion zone.

The fine-grained and dustlike fuel, particularly coal, is charged through a feeder 10 and the line 11 into the lower portion of the combustion zone 7 and is preferably blown into said zone.

Preheated primary air is delivered by the fan 13 into the bottom end of the fluidized bed furnace and secondary air is supplied by the fan 14.

Solids and gases leave the furnace through the duct 15 and are separated in the cyclone 2. The gases are withdrawn in line 17 and supplied to a gas-purifying system, not shown.

Part of the separated solids is recycled in lines 18 and 19 to the combustion zone 7. The remaining solids are fed in line 20 to the fluidized bed cooler 3.

The fluidized bed cooler 3 is divided by partitions 8 into a plurality of chambers 3*a*, 3*b*, 3*c*, which are only partly closed.

Solids and gases can pass from one chamber to the other. A fan 22 supplies each chamber with air for maintaining the solids in a fluidized state. A heat exchanger 6*a*, 6*b*, 6*c* is associated with each chamber.

If water to be evaporated is supplied to one of said heat exchangers, the latter will be described here as an evaporator. Any heat exchanger supplied with water vapor to be superheated will be described as a "superheater".

The heated exhaust air from the fluidized bed cooler 3 is delivered in line 23 to the combustion zone 7. Part of the cooled solids is also recycled in line 24 to the combustion zone 7.

Surplus solids are withdrawn in line 25.

Water from the water vapor accumulator 5 is delivered in line 28 to the bottom end of the heat exchanger 4 and the water vapor produced therein is withdrawn in line 29 and delivered to the accumulator 5. Preferably, preheated feed water is delivered to the accumulator in line 30. The water vapor which is produced is withdrawn in line 31.

A superheater 32, which may consist of a plurality of stages, is used to superheat the water vapor, which is then delivered in line 33 to the expansion turbine 34. Cooled water vapor or condensate leaves the turbine in line 35. After being processed by means, not shown, condensate can be recycled in line 30 into the accumulator 5.

It is apparent that any fluctuation in the rate at which water vapor is produced will become effective only with a long delay in the feed line 33 leading to the turbine 34 and that a control action must be taken in time if the steam rate in the line 33 is to be kept constant in accordance with the demand of the turbine. For that purpose, the plant is provided with various sensors, namely:

T1 for measuring the temperature in the upper region of the combustion zone near the passage 15;

T2 for measuring the temperature in the combustion zone somewhat below the bottom end of the heat exchanger 4;

T4 for measuring the temperature of the saturated vapor in the water vapor accumulator 5;

T5 for measuring the temperature of the water flowing in line 30 to the accumulator 5;

for measuring the pressure at the top end of the combustion zone above the heat exchanger 4; and for measuring the pressure in the combustion zone 7 slightly below the heat exchanger 4.

In the present case, the evaporators of the fluidized bed cooler 3 contribute to the steam production. For this reason, the temperature must also be monitored in each chamber which contains an evaporator. Chambers which contain a superheater are not monitored.

In FIG. 1 it is assumed that the heat exchanger **6*a* in chamber 3*a* is operated as a superheater and the heat exchangers 6*b* and 6*c* in chambers 3*b* and 3*c* serve to evaporate water. For this reason, chamber 3*c* is provided with the temperature monitor TV(2**).

In practice, the number of chambers of the fluidized bed cooler 3 may vary and evaporators may be contained in one or more of said chambers. If n evaporator chambers are provided, temperature sensors TV(l), TV(2) . . . and TV(n) will be used. In the calculations to be described hereinafter, the contributions of these various evaporators must be cumulated. For the sake of simplicity, the information furnished by a given sensor (pressure or temperature) will be designated like the sensor hereinafter.

Figure 2:
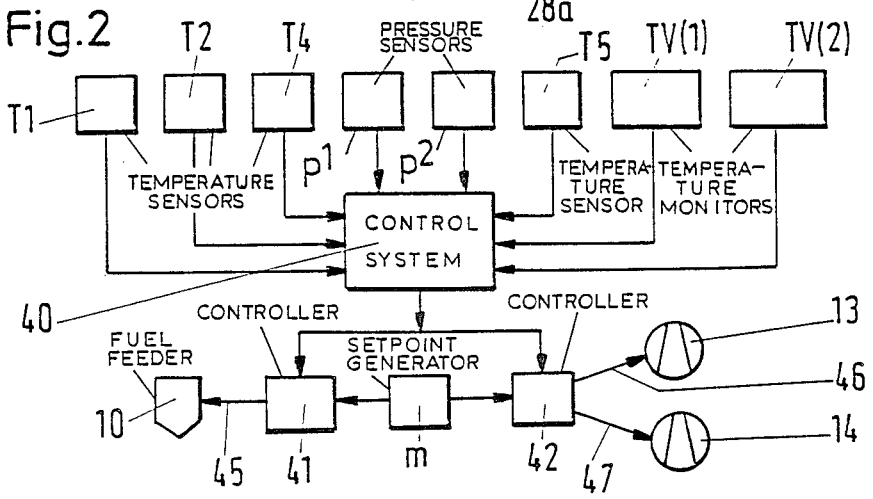
FIG. 2 is a block diagram which illustrates the processing of the measured values.

FIG. 2 illustrated how the information from the various sensors shown in FIG. 1, namely, T1, T2, T4, T5, p1, p2, TV(l) and TV(2), is delivered via signal lines to the control system may specifically be designed for the calculations to be described hereinafter or may consist of a computer. The control system 40 continually calculates the instantaneous rate at which water vapor is produced in the plant and delivers that information as an actual value to the controllers 41 and 42.

The desired value m indicating the rate at which water vapor fed in line 33 is required by the turbine 34 is also delivered to the controllers. The output signal of the controller 41 is delivered via the signal line 45 to the fuel feeder 10 to ensure that an inadequate vapor production will cause more fuel to be fed to the combustion zone 7. The controller 42 controls via the signal line 46 the fan 13 and via the signal line 47 and fan 14 and ensures that sufficient combustion air will be supplied to the combustion zone 7 when the fuel demand is increased.

The control system 40 comprises arithmetic circuits or is operated in accordance with an arithmetic program for calculating the heat transfer coefficients (K values) of the heat exchanger 4 and of the evaporators **6*b* and 6*c***, the heat fluxes in said parts of the plant, and from said parameters the total rate at which steam is actually produced. Those calculations are performed in accordance with the following formulas, in which temperature is stated in C and pressure in millibar:

For the heat exchanger 4:

$$\text{K value: } K = a\,x(p2-p1) - b + c\,x\,(T1+T2) + d \times T4$$

$$\text{Heat Flux: } W = K \times F \times (0.5 \times (T1+T2) - T4)$$

In these formulas,

F = heat exchange surface area of heat exchanger 4 in $m^2$.

Depending on the design of the plant, coefficients a, b, c and d lie in the following ranges:

a = 4 to 6 b = 75.9 to 121 c = 0.082 to 0.123 d = 0.104 to 0.157

The exact value of a coefficient must be determined during a trial operation of the plant.

The following formulas are applicable to any chamber i (i = 1, 2, . . . n) which contains an evaporator:

$$\text{K value: } K(i) = a(i) + c(i) \times TV(i) + d(i) \times T4$$

$$\text{Heat Flux: } W(i) = K(i) \times F(i) \times (TV(i) - T4)$$

In these formulas

F(*i*) = heat exchange surface area of the evaporator in chamber (*i*) in $m^2$.

The coefficients lie in the following ranges:

a(*i*) = 170 to 285 c(*i*) = 0.162 to 0.205 d(*i*) = 0.124 to 0.156

The total rate M (in kg/sec) at which water vapor is produced in all evaporators is determined by the formula M = X:Y.

$$\text{wherein } X = W + \sum_{i=1}^{n} Wk(i) \text{ and}$$

$$Y = 1000 \times (3448 - 1.89 \times T4 - 4.86 \times T5)$$

These formulas are applicable to plants which differ in size and are provided or not provided with a fluidized bed cooler.

We claim:

1. A method of operating a combustion plant which comprises the steps of:

effecting combustion of a fine-grain dustlike solid fuel with air in a combustion zone of a circulating fluidized bed;

effecting heat exchange with said circulating fluidized bed in an upper end of said zone;

accumulating water vapor from said heat exchanger;

driving a turbine with water vapor from said accumulator;

continuously calculating the rate at which water vapor is produced in said heat exchanger and automatically comparing the calculated rate at which water vapor is produced with a setpoint rate at which water vapor is required by said turbine; and adjusting rates at which said fuel and air are fed to said combustion zone in accordance with the comparison of the rate at which water vapor is produced in the heat exchanger with said setpoint rate.

2. The method defined in claim 1, further comprising the steps of cooling solids discharged from said bed in a fluidized bed cooler having a plurality of chambers containing heat exchangers for evaporation of feed water and of superheating water vapor;

supplying fluidized air to said chambers;

feeding a portion of cooled solids from said fluidized bed cooler and air as discharged from at least one of said chambers to said combustion zone; and calculating the rate at which water vapor is produced in the heat exchanger for evaporation of feed water and combining the rate at which water vapor is produced in the heat exchanger for evaporation of feed water with the rate at which water vapor is produced by said heat exchanger in said zone to provide a total rate of water vapor production.

3. The method defined in claim 2 further comprising the steps of measuring pressure and temperature above and below the heat exchanger in said zone and the temperature in said chambers in which heat exchangers which produce water vapor are calculating heat transfer coefficients of the heat exchangers which evaporate water in response to the measurements of said pressure and temperatures;

measuring temperature in said water vapor accumulator and calculating an instantaneous rate of water vapor production in response to said coefficients and the temperature in said water vapor accumulator, the calculated total rate being compared with said setpoint value and rates at which fuel and air are supplied to said combustion zone being changed upon deviation of the calculated total rate from said setpoint value in a sense bringing said total rate into coincidence with said setpoint value.

* * * * *